US006138278A

United States Patent [19]

Taylor et al.

[11] Patent Number: 6,138,278

[45] Date of Patent: Oct. 31, 2000

[54] MEDICAL GOWN WITH AN ADHESIVE CLOSURE

[75] Inventors: Jeffrey L. Taylor, Arlington; Carmen A. Pinilla, Dallas, both of Tex.; Jorge Serrano, Chihuahua, Mexico; James Dennis Hart, Larkspur, Colo.

[73] Assignee: Ethicon, Inc., Skillman, N.J.

[21] Appl. No.: 09/207,538

[22] Filed: Dec. 8, 1998

Related U.S. Application Data

[60] Provisional application No. 60/067,941, Dec. 8, 1997.

[51] Int. Cl.[7] ..... A41B 9/00

[52] U.S. Cl. ..... 2/114

[58] Field of Search ..... 2/114, 46, 47, 2/48, 49.1, 50, 51, 52, 70, 92, 104

[56] References Cited

U.S. PATENT DOCUMENTS

| | | | |
|---|---|---|---|
| 3,259,913 | 7/1966 | Tames . | |
| 3,359,569 | 12/1967 | Rotanz et al. . | |
| 3,490,072 | 1/1970 | Keltner . | |
| 3,570,012 | 3/1971 | Winters . | |
| 3,574,864 | 4/1971 | Bradley . | |
| 3,721,999 | 3/1973 | Goya et al. . | |
| 3,745,587 | 7/1973 | Bradley . | |
| 3,754,284 | 8/1973 | Hartigan et al. . | |
| 3,824,625 | 7/1974 | Green . | |
| 3,843,971 | 10/1974 | Delanty et al. . | |
| 3,911,499 | 10/1975 | Benevento et al. . | |
| 3,935,596 | 2/1976 | Allen, Jr. et al. . | |
| 3,977,025 | 8/1976 | Horan . | |
| 4,000,521 | 1/1977 | Zoephel et al. . | |
| 4,016,604 | 4/1977 | Welke . | |
| 4,017,909 | 4/1977 | Brandriff . | |
| 4,019,207 | 4/1977 | Newman et al. | 2/51 |
| 4,040,124 | 8/1977 | Zoephel . | |
| 4,255,818 | 3/1981 | Crowley et al. | 2/51 |
| 4,290,148 | 9/1981 | Roberts . | |
| 4,326,300 | 4/1982 | Bolton et al. . | |
| 4,369,527 | 1/1983 | Paul | 2/51 |
| 4,370,782 | 2/1983 | Aronica | 24/198 |
| 4,371,986 | 2/1983 | Wichman | 2/51 |
| 4,373,214 | 2/1983 | Wichman | 2/51 |
| 4,384,370 | 5/1983 | Singer | 2/114 |
| 4,395,782 | 8/1983 | Reynolds | 2/114 |
| 4,457,024 | 7/1984 | Wichman | 2/51 |
| 4,558,468 | 12/1985 | Landry et al. . | |
| 4,570,268 | 2/1986 | Freeman . | |
| 4,586,196 | 5/1986 | White . | |
| 4,612,673 | 9/1986 | Underhill | 2/114 |
| 4,674,132 | 6/1987 | Stein et al. . | |
| 4,718,124 | 1/1988 | Sawicki et al. . | |
| 4,982,448 | 1/1991 | Kogut . | |
| 5,033,115 | 7/1991 | Bowling et al. . | |
| 5,062,159 | 11/1991 | Jakub . | |
| 5,133,086 | 7/1992 | Truitt et al. | 2/114 |
| 5,184,351 | 2/1993 | Benstock . | |
| 5,271,100 | 12/1993 | Holt . | |
| 5,410,758 | 5/1995 | Dupont et al. . | |
| 5,414,867 | 5/1995 | Bowling et al. . | |
| 5,651,140 | 7/1997 | Gibson . | |
| 5,652,962 | 8/1997 | Patnode | 2/114 |
| 5,901,376 | 5/1999 | Deirmendjian et al. . | |

*Primary Examiner*—John J. Calvert
*Assistant Examiner*—Shirra L. Jenkins
*Attorney, Agent, or Firm*—Andrew C. Farmer

[57] ABSTRACT

A medical gown and drape are disclosed in which regions thereof are imprinted with performance enhancing coatings. The gown has regions in the chest and sleeve areas imprinted with a liquid repellent coating to protect the wearer from fluids. The drape preferably has an absorbent or super absorbent coating surrounding a fenestration through which an operation may occur. The drape may also have regions coated with water repellent or friction enhancing materials. The gown further has adhesive closures rather than ties.

9 Claims, 15 Drawing Sheets

MEDICAL GOWN WITH AN ADHESIVE CLOSURE

This application claims the benefit of U.S. Provisional Application No. 60/067,941 filed Dec. 8, 1997.

THE FIELD OF THE INVENTION

The present invention relates to medical gowns, and more particularly to medical gowns having adhesive closures.

BACKGROUND OF THE INVENTION

Medical gowns are typically closed with ties. They are open at the back and a tie is provided across the two back panels of the gown at the waist. Ties may also be provided inside the gown at the waist (similar to the inside button of a double-breasted suit) and at the neck. To avoid having the ties touch a nonsterile hands, they are sometimes attached to a transfer card which can be passed to an assistant by the sterile wearer, whereby the assistant may pass at least one of the ties around the wearer's waist touching only the card. The wearer then grasps the tie, the card is removed and the wearer ties the ties. The assistant need not be sterile. The Allen, Jr. et al. U.S. Pat. No. 3,935,596 issued Feb. 3, 1976, and incorporated herein by reference, discloses such a method.

Ties with a transfer card are cumbersome to assemble and medical gowns, particularly disposable medical gowns, must be produced at low cost.

SUMMARY OF THE INVENTION

A medical gown according to the present invention comprises a body covering portion and sleeves extending from the body portion. The body portion has an opening for donning the gown and at least one closure for closing the opening. The closure comprises an adhesive on a first side of the opening and a region on the second side of the opening to which the adhesive attaches to close said opening.

Preferably, the body covering portion is formed of a nonwoven fabric. The adhesive may be printed directly onto the gown fabric on the first side, may comprise a piece of double-sided tape affixed to the first side, or other suitable method.

When the gown is sterile, the adhesive can be located on an a first side of an attachment portion of the gown with a removable member on a second side of the attachment portion. Thus a non-sterile hand may press against the removable member to adhere the adhesive to the second side and then remove the removable member leaving a wholly sterile gown. The removable member can comprise a release member removably placed over the adhesive.

Preferably indicia indicating a sequence of steps for applying said closure in a sterile fashion are provided.

The closure may further comprise a removable member adjacent the opening for manipulating the closure into position for adhering the adhesive and the gown, whereby a nonsterile hand may place closure in such position and then remove the removable means to leave a sterile closed gown.

A method according to the present invention for closing a medical gown comprises the steps of exposing an adhesive on a first side of an opening in the gown, and attaching the adhesive to a location on a second side of the opening.

DETAILED DESCRIPTION

Figure 1:
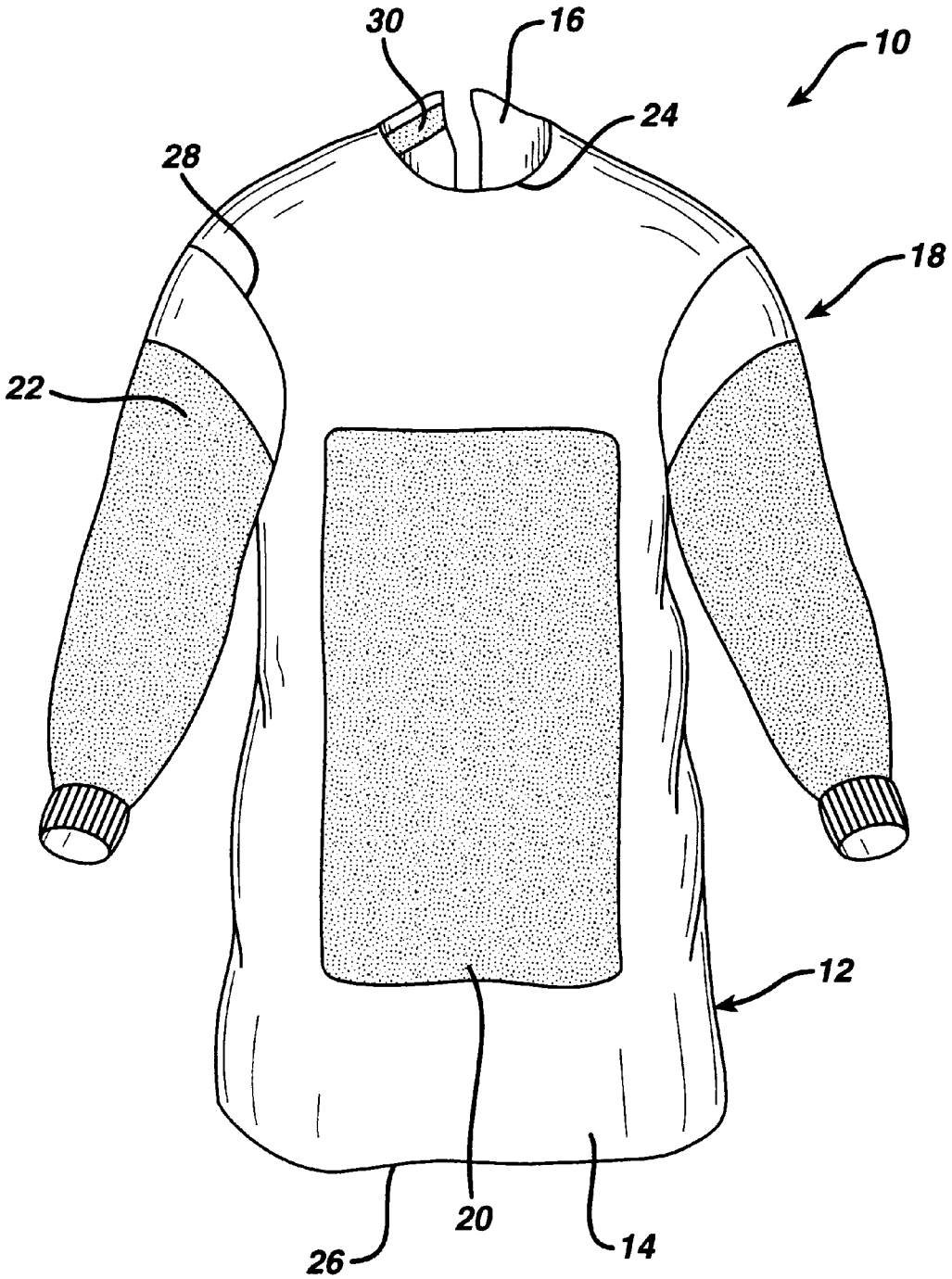
FIG. 1 is a front elevational view of a gown according to the present invention.

FIG. 1 illustrates a medical gown 10 according to the present invention. It comprises a body 12 having a front portion 14 and back portion 16 and a pair of sleeves 18. The body and sleeves are formed of a suitable nonwoven material to provide a disposable gown; however, a reusable fabric such as cotton may also be employed. Preferably such material is breathable allowing transpiration of air and water vapor to improve the comfort of the wearer. Suitable fabrics include polyester-wood pulp hydro-entangled nonwovens treated with fluorocarbons to enhance repellency, such as FABRIC 450, from Johnson & Johnson Medical, Inc. and SONTARA available from DuPont. The back portion 16 may be formed of less substantial and untreated fabrics. For instance, the front portion 14 preferably exhibits a repellency of between 20 and 30 cm static head, most preferably about 25 cm, but the back portion 16 can be less than 20, and preferably about 10 to lower cost and enhance overall breathability of the gown.

AATCC Test Method 127-1989 measures the resistance of fabrics to the penetration of water under static pressure, with the water column being measured in centimeters. Test specimens are mounted under the orifice of a conical well and are subjected to water pressure increasing at a constant rate (1 cm/sec) until three points of leakage occur through the fabric. The ASTM Emergency Standard 21 and 22 define imperviousness for medical gowns. One side of a test sample of fabric is exposed to synthetic blood medium (with a bacteriaphage for method 22). Pressure is applied across the test sample of the fabric on the following schedule: 5 minutes at atmospheric pressure (on both sides of the fabric), one minute with 2 psi applied to the fluid side of the fabric, the other side remaining at atmospheric pressure, followed by 54 minutes with both sides at atmospheric pressure.

A coating of impervious material is applied to a chest area 20 and to sleeve areas 22. The chest coating 20 generally need not necessarily extend up to a neck 24 or down to a lower edge 26 of the gown 10, but broader coverage with the coating 20 provides enhanced protection. It should extend laterally to cover a frontal portion of a wearer's body (not shown). The gown 10 in FIG. 1 is shown in a somewhat open configuration prior to being donned by a wearer and it would be expected that when so donned the chest coating 20 would cover the frontal area of a wearer's body. The sleeve coatings 22 extend from a cuff 28 up toward a shoulder seam 29 where the sleeves 18 join the gown body 12 however, the sleeve coating 22 need not extend all the way to the shoulder seam 28. The precise location of the chest coating and sleeve coatings 22 can be manipulated by those of skill in the art to meet the particular needs of a given gown or surgical procedure for which it is intended.

Preferably, the liquid impervious coatings 20 and 22 are provided by coating a liquid repellent material, such as a film-forming polymer, selectively to areas of the fabric substrate, then drying the polymer to form a coherent film on the fabric substrate impervious to liquid. Preferably the coatings 20 and 22 are applied prior to the gown being sewed or otherwise assembled together, but they could be applied after the gown is constructed. The preferred application method would be determined primarily by the throughput requirement, the coating weight desired and cost. Preferably a doctor blade, air knife, reverse rollercoating, or rotary screen printing process is employed. Each of these methods is capable of depositing coating weights in the range of 50 to 200 microns. Most preferably a rotary screen printing method is employed as it most easily can deposit the coating in a desired pattern. Such a process will be described hereinafter with respect to FIG. 15.

There are many film forming polymer systems capable of providing impervious barriers to body fluids. A suitable polymer should be selected on the basis of its ability to be cast from solution, its flexibility after the coating is dried and its cost. A preferred material is polyvinylchloride plastisol which has a high solids content (greater than 95%) which limits the cost of treating solvent emissions released during the drying and curing process. Other suitable coatings include polyurethanes, polyetherurethanes, polyethylenes, and polypropylenes. In any event, the coated fabric should be impervious to bodily fluids.

Figure 2:
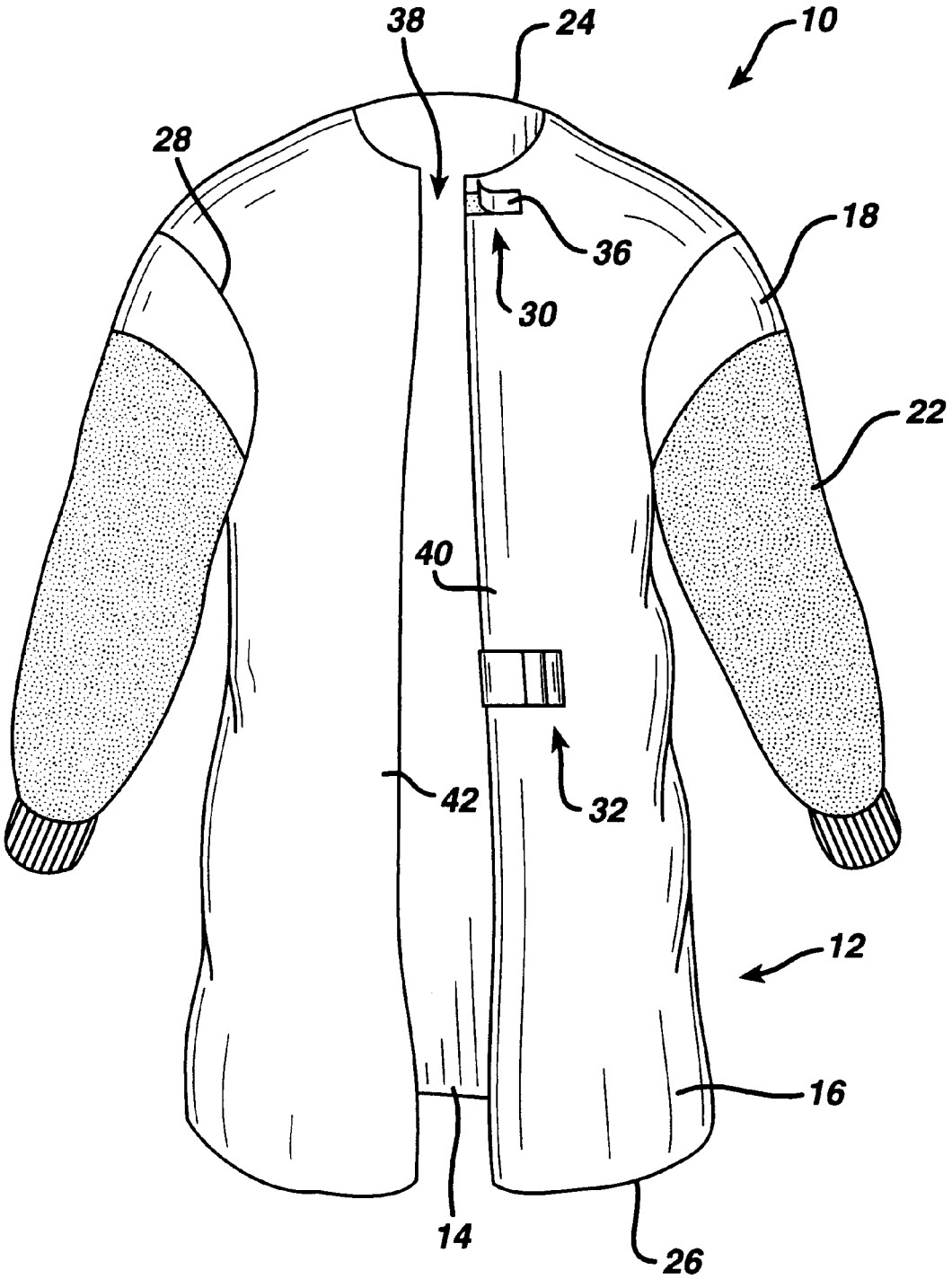
FIG. 2 is a rear elevational view of the gown of FIG. 1.

FIG. 2 shows the back of the gown 10 and a taped type neck closure 30 and waist closure 32. The neck closure 30 comprises a tab 34 coated with an adhesive and overlaid with a release liner 36, such as siliconized paper. To adhere the neck closure 30, the release liner 36 is removed and the tab 34 is folded over and attached to the gown back 16. Alternatively, an area of the gown back 16 at the neck 24 may be coated with an adhesive and have a release liner (not shown in FIG. 2) attached thereover. Closure can then be effected by removing the release liner and adhering the two sides of the gown back 16 together at the adhesive.

Figure 3:
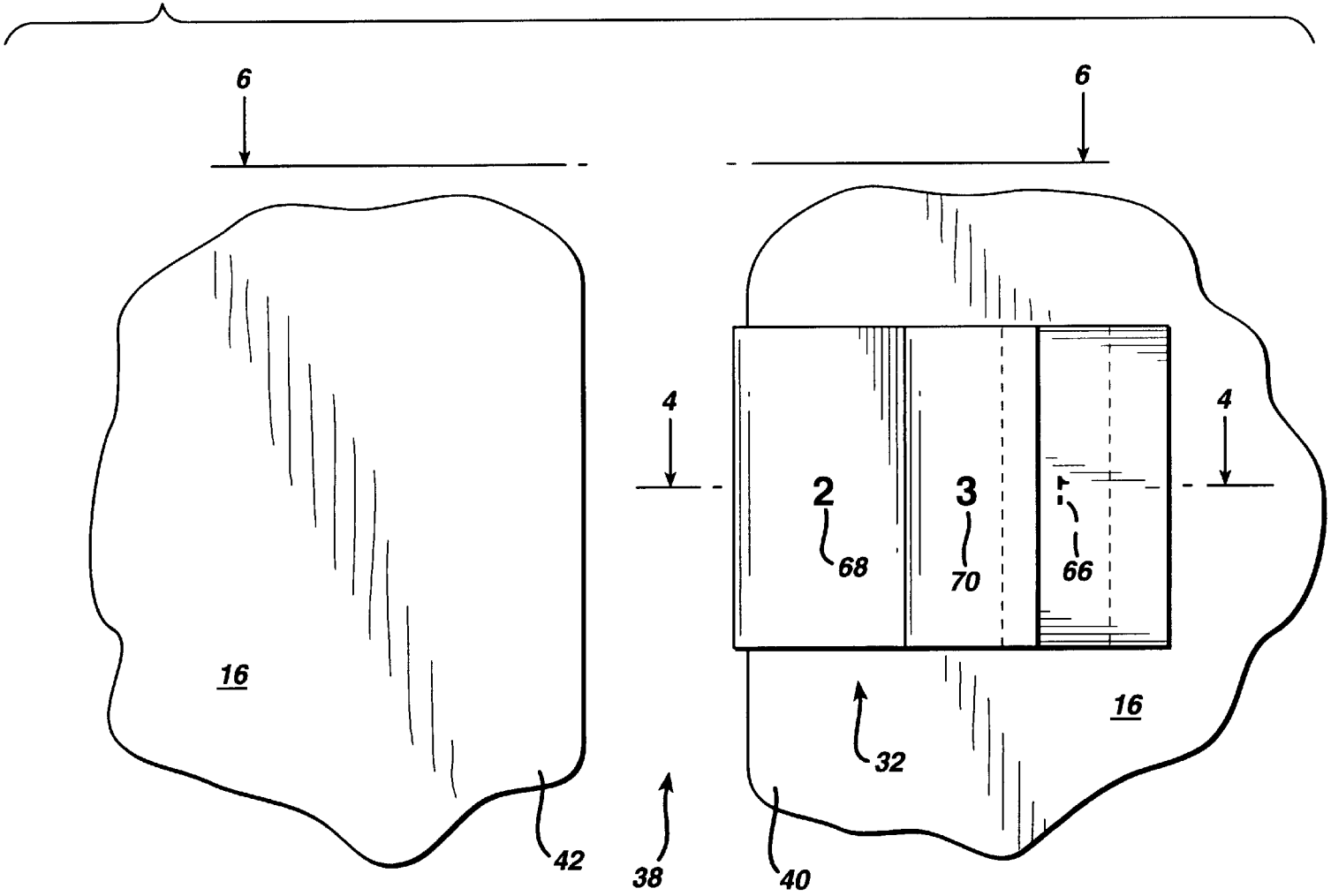
FIG. 3 is a close-up view of a portion of the gown of FIG. 2, showing a gown closure mechanism.
Figure 4:
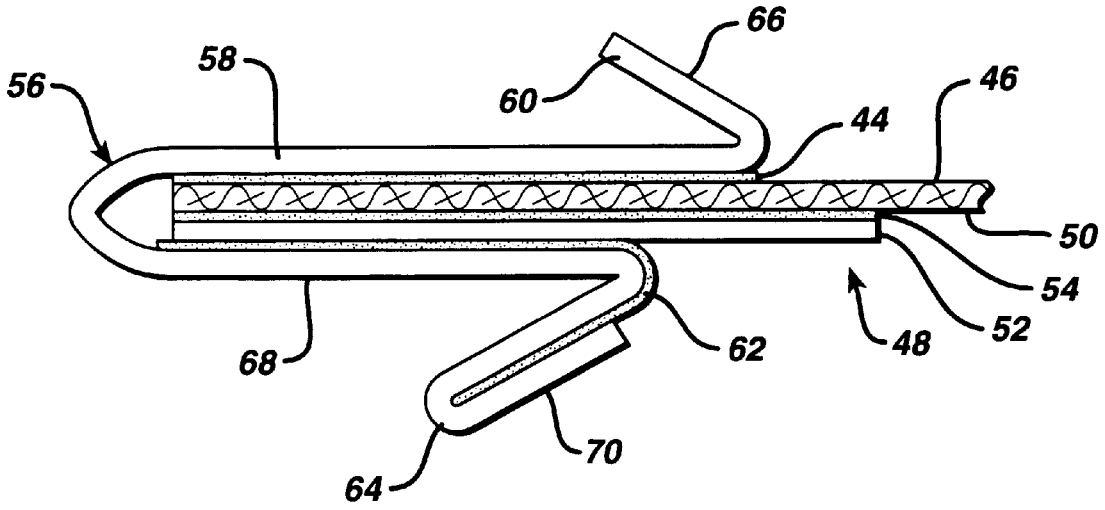
FIG. 4 is a sectional view taken along lines 4—4 of FIG. 3.
Figure 5:
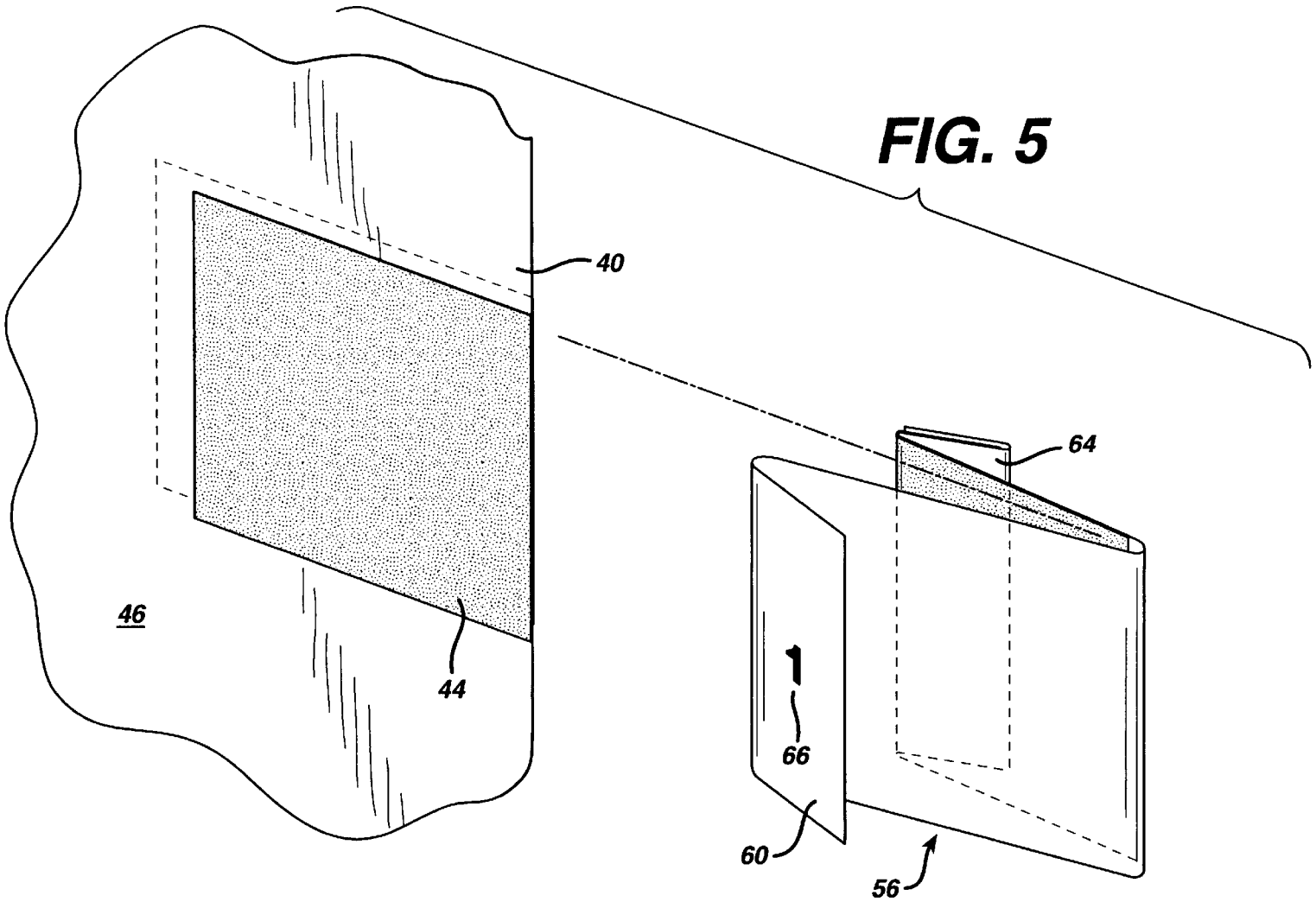
FIG. 5 is a partially exploded perspective view of the closure of FIG. 3.
Figure 6:
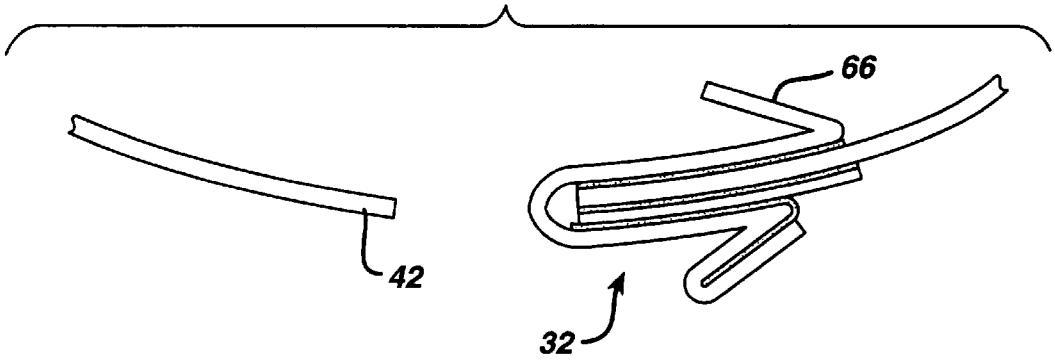
FIG. 6 is a sectional view taken along lines 6—6 of FIG. 3.

FIGS. 3 to 5 illustrate the waist closure 32 in more detail. The gown 10 has an opening 38 in the back 16. A first edge 40 and second edge 42 are connected to each other to effect closure. The waist closure 32 comprises a first adhesive layer 44 on an inside surface 46 of the gown back 16 at the first edge 40. A release material 48 is applied to an outside surface 50 of the gown back 16 in registry with the first adhesive layer 44. The release surface 48 may comprise a release liner 52 adhered to the outside surface 50 with an adhesive 54. A special release strip 56 covers the first adhesive layer 44 and aids in applying the waist closure 32 in a sterile fashion. The release strip 56 is formed of a long strip of release liner 58 having one end thereof folded over to form a tab 60. From the tab 60 the release liner 58 extends across the first adhesive layer 44, and round the first edge 40. Adhesive 62 on the release liner 58 adheres to the release surface 48 on the outside surface 50. The release liner 58 terminates in a bi-fold tab 64 wherein the release liner first folds away from the release surface 48 and then back upon itself to cover the adhesive 62.

The release strip 56 bears indicia to indicate the steps in the sterile application of the waist closure 32. For instance, the tab 60 bears an indicia 66, such as the numeral "1", indicating that the first step in the application of the waist closure 32 is to pull the tab 60 and release the release strip 56 from the first adhesive layer 44. A second indicia 68, such as the numeral "2", appears on the release strip where it covers the release surface 48 and a third indicia 70, such as the numeral "3", appears on the bi-fold tab 64.

Figure 7:
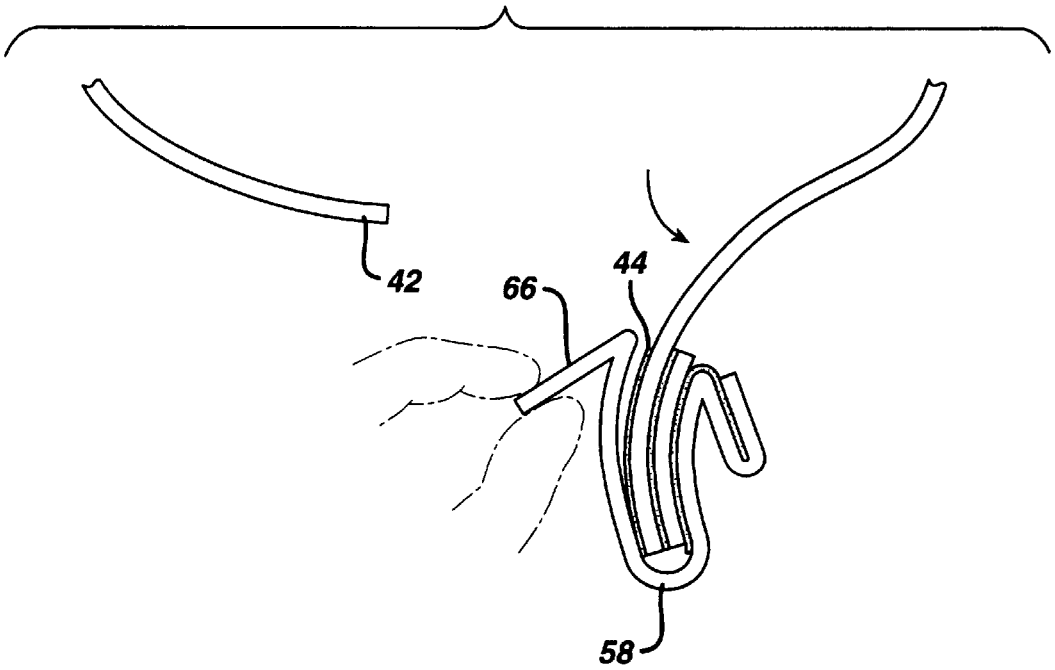
FIGS. 7 to 10 are sectional views similar to FIG. 6 illustrating operation of the closure.
Figure 8:
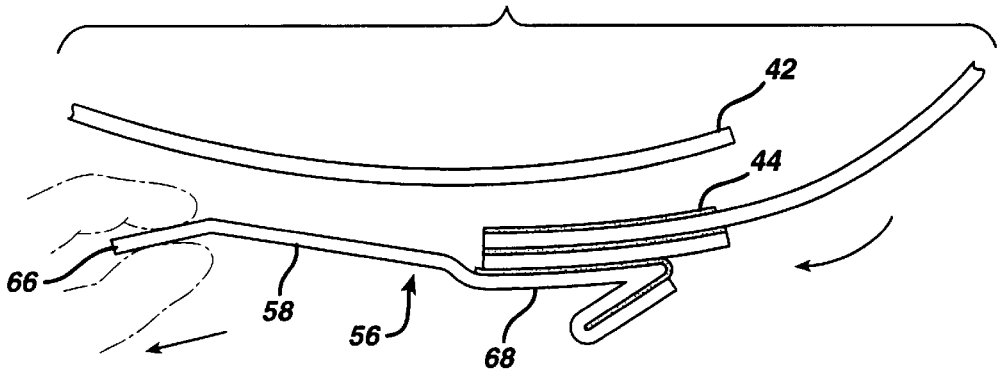
Figure 9:
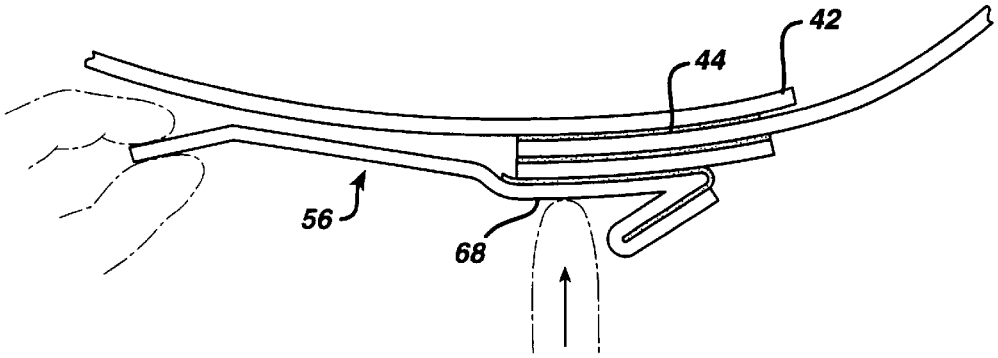
Figure 10:
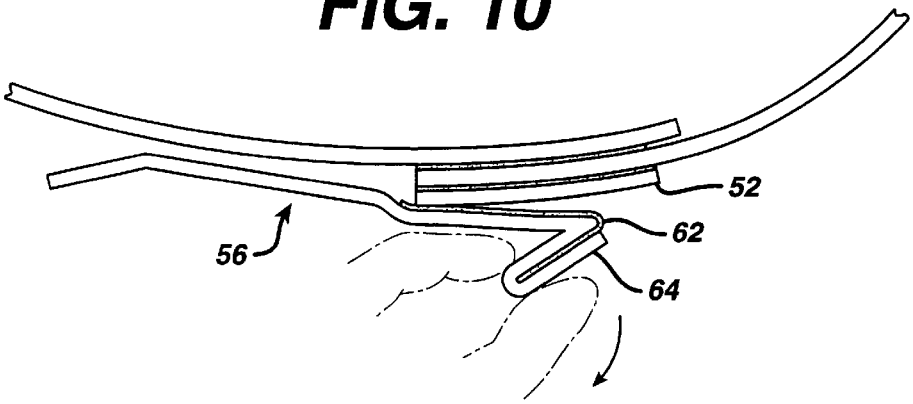
Figure 11:
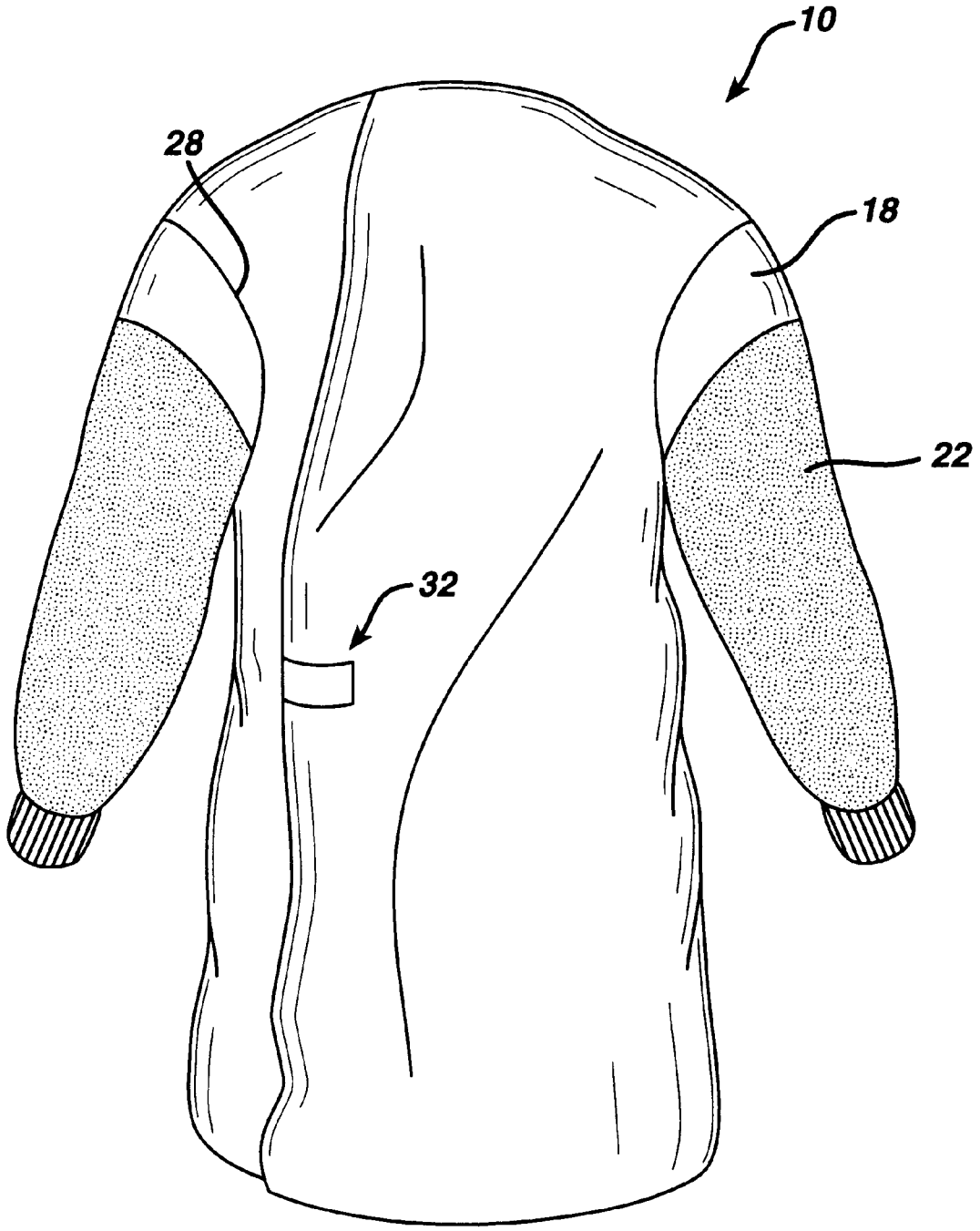
FIG. 11 is a rear elevational view of the gown of FIG. 2, shown closed.

FIGS. 6 to 10 illustrate the procedure for applying the waist closure 32. First, the user grasps tab 60 to remove the release strip 56 from the first adhesive layer 44, as illustrated in FIG. 7. This procedure may be performed with a non-sterile hand and still effect sterile closure of the waist closure 32 as will be illustrated. By holding the tab 60, the first adhesive layer 44 may be properly positioned over the gown back 16 adjacent the second edge 42. By applying pressure at the second indicia 68, such as with a finger, the first adhesive layer 44 is adhered to the gown back 16. Finally, the bi-fold tab 64 is grasped, and the release strip 56 is removed and discarded. During the procedure only the release strip 56, which is discarded, is touched with non-sterile hands. The final closure is illustrated in FIG. 11.

Other treatments may be applied to the underlying fabric to provide regional performance characteristics to a gown, or also to a surgical drape. For instance, some gown and drape applications, for example those used for less wet procedures, do not require complete imperviousness and some lesser levels of water repellency may be adequate. Currently, this is achieved by immersing the entire fabric in a fluorocarbon based repellency agent. The excess liquid is then expressed and the fabric dried. The treatment is repeated to achieve an acceptable level of repellency characterized by a static head of between 20 and 30 cm, preferably about 25 cm.

Using the method of the present invention as an alternative, a water based emulsion of acrylic ester, or other repellency enhancing substance such as a fluorocarbon or silicone, may be printed onto the fabric substrate. On many nonwoven substrates, the preferred dry coating weight for acrylic ester is approximately 2.0 grams per square yard, which corresponds to a coated fabric with a hydrostatic head of 25 cm. One of skill in the art can determine the appropriate coating level to achieve desired levels of repellency with a given fabric substrate and coating material without undue experimentation. Achieving the 25 cm level of repellency does not depend critically on a particularly printing process, and techniques such as rotogravure or flexography which deliver lower coating weights, are suitable. Using the method of the present invention, the emulsion or other repellency enhancing material need only be applied where the added repellency is required. For instance, the back portion 15 of the gown 10 can be made from a rather insubstantial nonwoven fabric with low repellency and yet have its repellency raised in this manner.

It may be desired, especially in the instance of drapes to have an area with enhanced absorption. Currently this is provided by laminating an absorbent layer of material to the fabric of the drape. Such material is capable of absorbing body fluid, such as blood, to create a relatively dry area where a surgeon may more easily work. Instead, according to the present invention, it is possible to print a layer of absorbent material, such as an acrylic acid based superabsorbent, either as a finished polymer or as a water base suspension of the precursor compounds, to a localized region to provide enhanced fluid absorptive capability. Preferably, this would be provided adjacent a fenestration through which surgical procedure is to be performed. Employing any of the well known acid based superabsorbent materials, such a coating would be capable of absorbing a greater volume of liquid than conventional laminated fabric materials. Based upon the present disclosure, other printable absorbent materials will be apparent to those of skill in the art.

Figure 12:
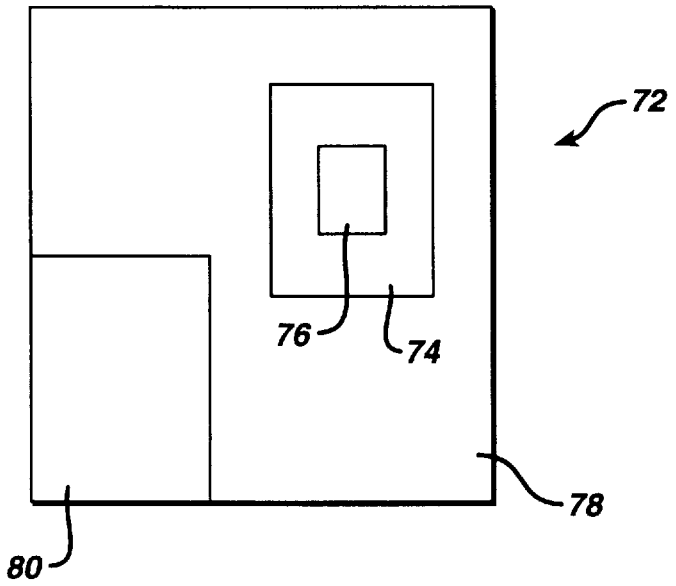
FIG. 12 is a plan view of a drape according to the present invention, shown prior to assembly.
Figure 13:
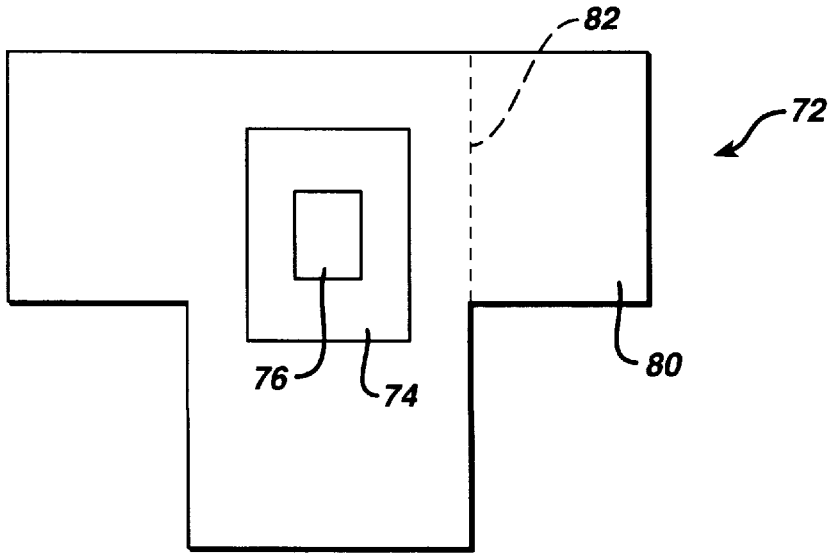
FIG. 13 is a plan view of the assembled drape of FIG. 12.

FIGS. 12 and 13 illustrate a T-shaped (a common drape configuration) drape 72 having a region of enhanced absorption 74 printed thereon about a fenestration 76 therethrough. FIG. 12 illustrates the drape 72 prior to assembly. A rectangular sheet 78 of a non-woven fabric has the area of enhanced absorption 74 printed thereon at the fenestration 76. A rectangular corner 80 is cut from the sheet 78. FIG. 13 illustrates the corner 80 attached to a side edge 82 of the sheet 78 to form the T configuration.

It may also be desirable to enhance friction in certain regions of a drape or gown. For instance drapes sometimes carry a thin layer of open cell foam located adjacent to incision cite. This material has a high coefficient of friction and the surgeon is able to place his instruments on the pad with the certainty that irrespective of the angle, the item will not slip. A similar effect can be achieved using a printed film of polyvinyl chloride plastisol containing a high concentration of non-migratory plastisol-trimellitate ester. When the solvent has been driven off and the plastisol cured, the resulting film has an extremely high level of tack and behaves in a way similar to a conventional foam instrument pad. Such a high tack coating, on a fabric base, can also be used as a liner for an instrument tray. Other tack enhancing coatings will be apparent to those of skill in the art.

The performance enhancing coating can be applied to the fabric substrate in any appropriate manner. A fluid coating material is applied and adhered to the substrate. The fluid may comprise the performance enhancing material dissolved in a solvent, or mixed into a suspension with a liquid carrier, in which case the solvent or carrier will typically be evaporated or otherwise at least partially removed to fix the material to the substrate. Alternatively, the fluid material may comprise a granular flowable powder of the material, in which case it may be fixed to the substrate electrostatically, or by fusion. Any conventional printing or spray coating method may be employed as long as there is some way to control where the coating will be applied so as to coat distinct regions of the substrate. Other methods for adhering a fluid coating to the substrate will be apparent to those of skill in the art.

Figure 14:
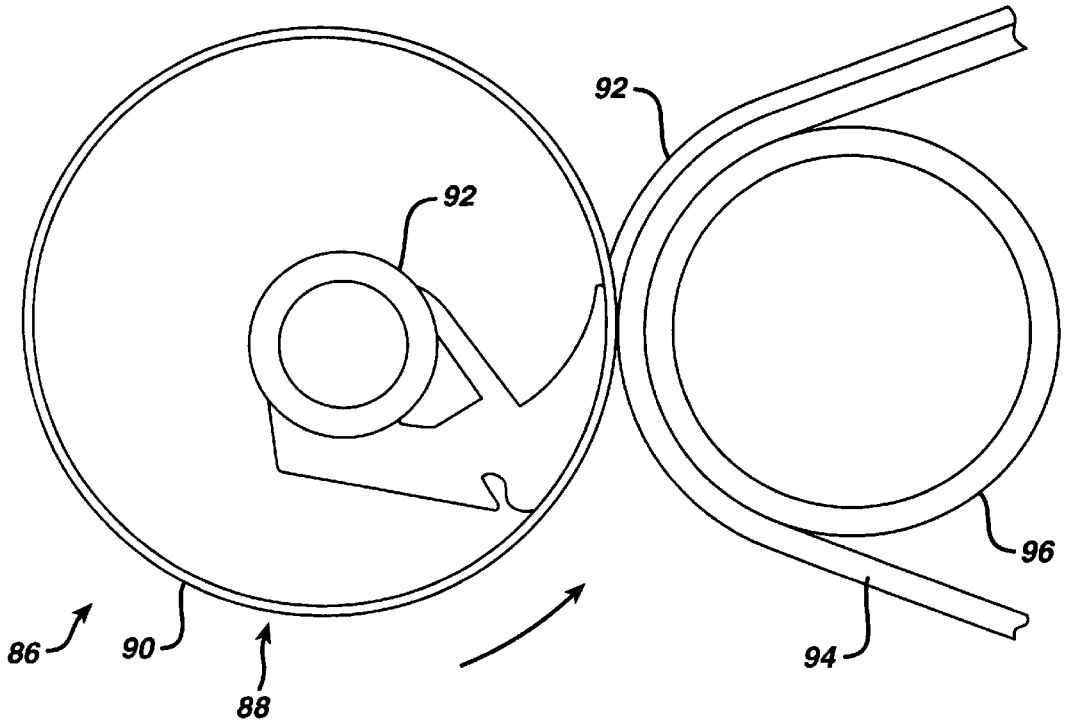
FIG. 14 is a sectional view of a rotary screen printer for printing performance enhancing materials onto selected regions of medical linens according to the present invention.

FIG. 14 illustrates a rotary screen printing mechanism 86 suitable for applying performance-enhancing coatings. It comprises a rotating drum 88 having perforations 90 therethrough in a pattern adapted to print the predetermined design. A squeegee 91 inside the drum 88 forces a flowable coating material 92 through the perforations 90 where they exist to apply a pattern of the coating material 92 onto a fabric substrate 94. The substrate 94 passes over a roll 96, which may be driven, and which places the substrate 94 into contact with the drum 88.

Figure 15:
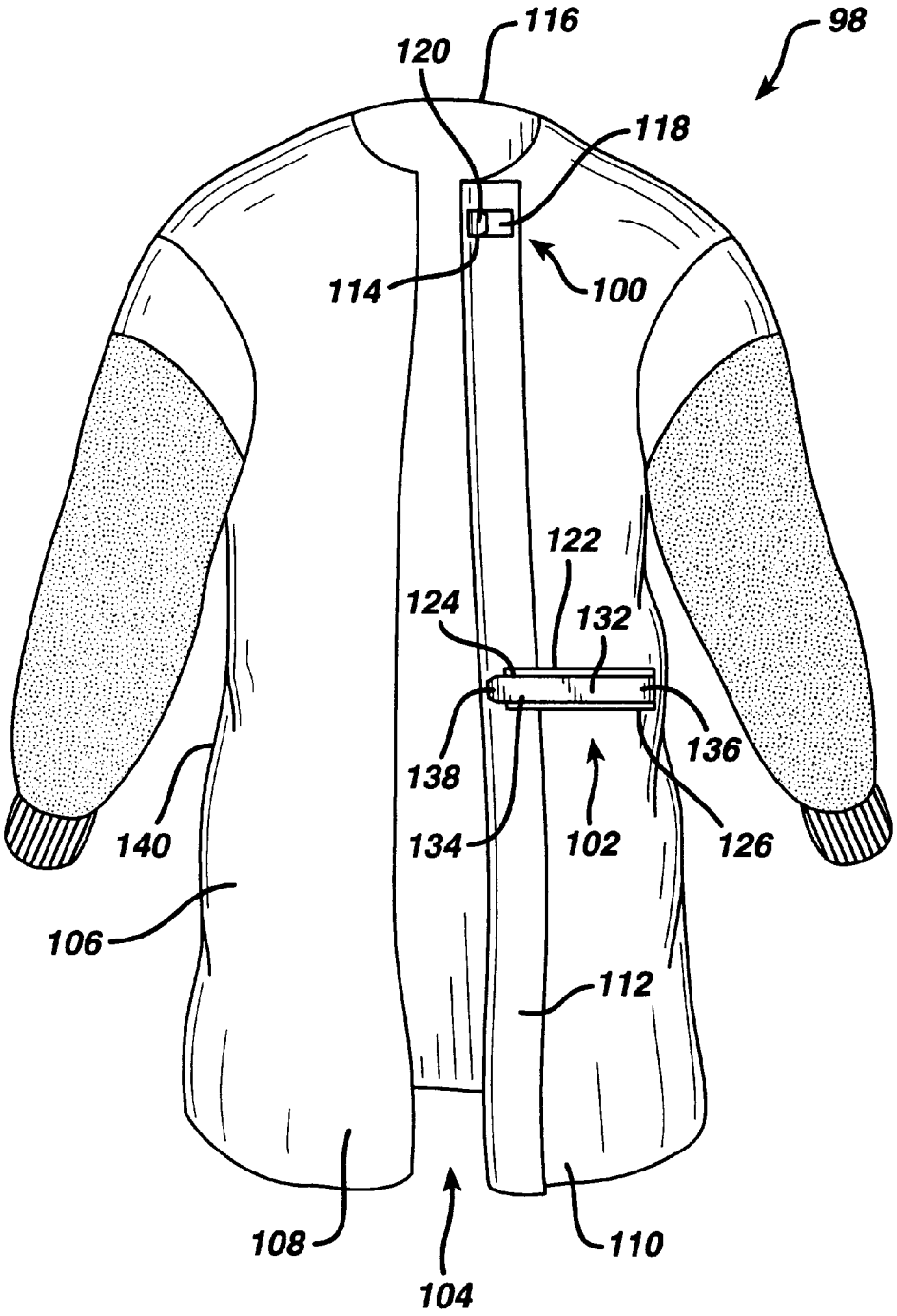
FIG. 15 is a rear elevational view of a further embodiment of a gown according to the present invention.
Figure 16:
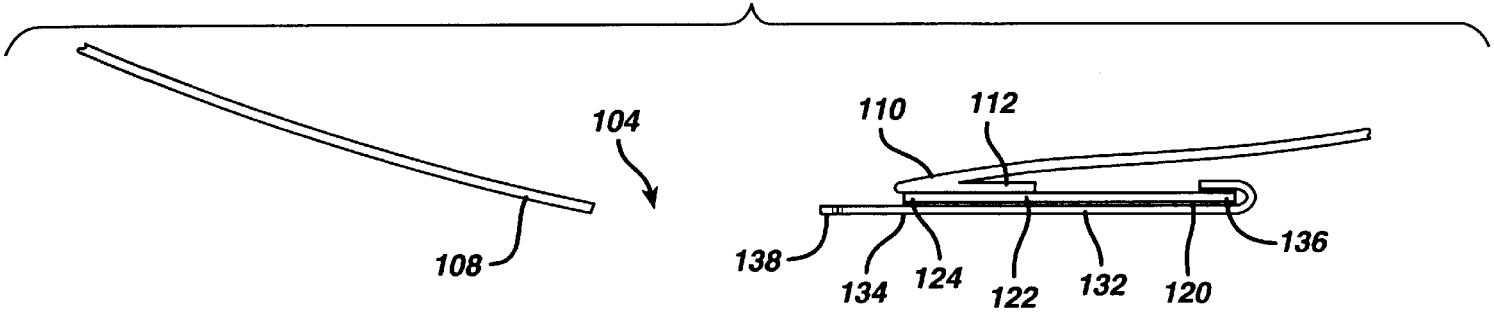
FIGS. 16 to 19 are sectional views through a waist closure of the gown of FIG. 15, showing its operation.
Figure 17:
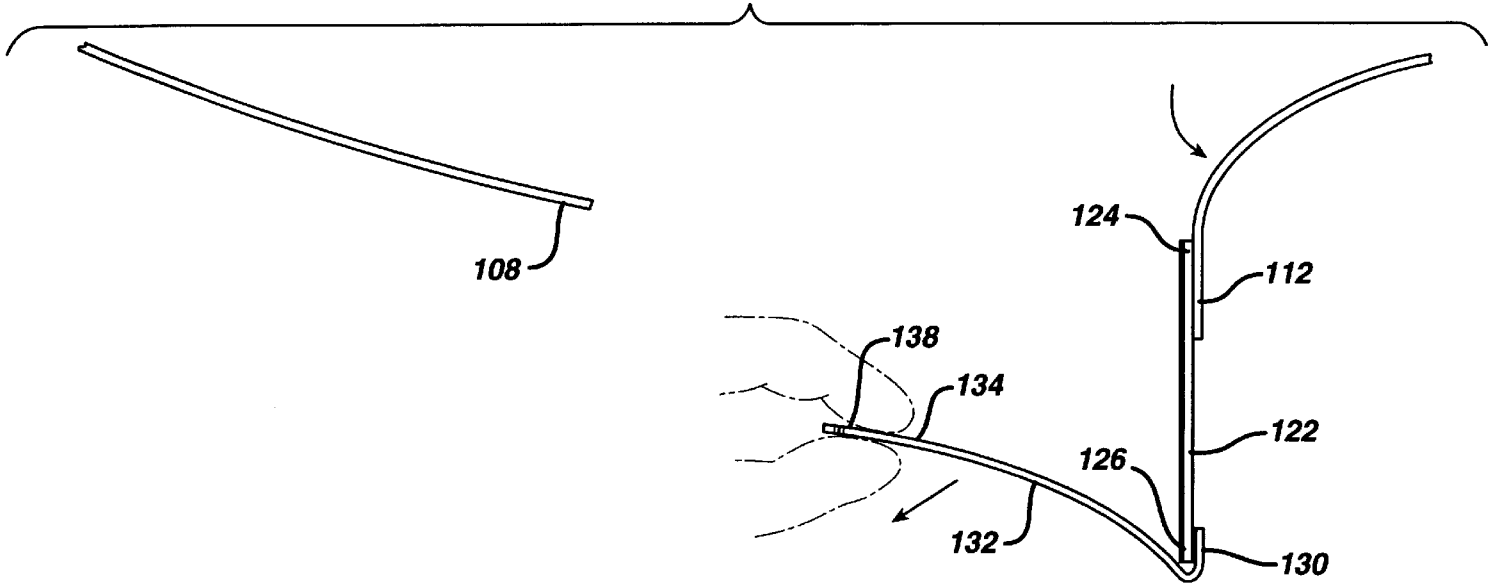
Figure 18:
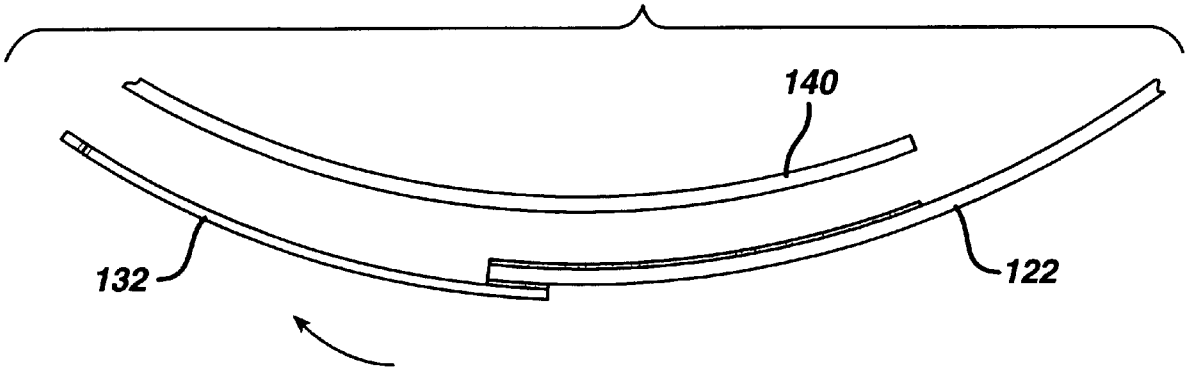
Figure 19:
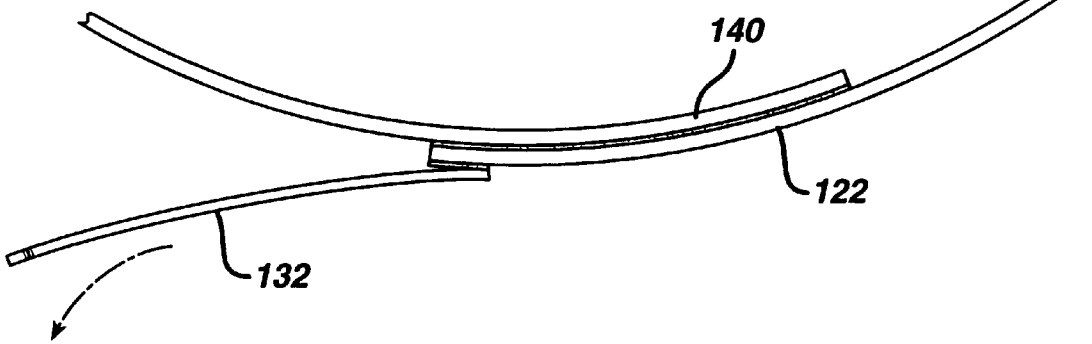

FIG. 15 illustrates a gown 98 having alternative neck and waist closures 100 and 102. An opening 104 extends up the back 106 of the gown to provide left and right back panels 108 and 110. The right back panel 110 is folded over outwardly along its length forming a flap 112. A region of adhesive 114 is provided on the flap 112 near the gown's neck 116. This may be printed thereon, preferably simultaneously or contemporaneously with the repellent coatings to speed construction of the gown 98, or may comprise a double-faced tape. A release liner 118 with a free-end tab 120 covers the adhesive 114. The neck closure 100 operates by removing the release liner 118 by means of the tab 120 and then folding the flap 112 at the region of the adhesive 114 over onto the left back panel 108 where the adhesive 114 adheres the two back panels 108 and 110 together. See also FIG. 21.

The waist closure 102 has a pass-off feature which achieves an effect similar to pass-off cards used on some surgical gowns with ties at the waist. With these gowns, the ties are attached to a card which is passed by a wearer to an assistant, who need not be sterile, merely clean. The assistant then passes one of the ties around the wearer's torso touching only the card. The wearer then grasps the tie and the non-sterile tie is removed.

The closure 102 comprises a strip 122, which preferably is formed of the same material as the gown 98, and which extends laterally from a first end 124 thereof attached to the flap 112 to a second end 126 attached at the side 128 of the gown 98. A face 130 of the strip 122 which faces outwardly bears an adhesive with a release liner 132 thereover. The release liner similarly has a first end 134 and a second end 136, corresponding to the strip first and second ends 124 and 126. The release liner first end 134 extends slightly from the adhesive to form a tab 138 and the second end 136 is releasably attached to the strip second end 126, but with significantly greater force than the attraction between the adhesive and the release liner 132. For instance, it may be physically attached thereto, such as by stapling, or bonded with a stronger adhesive.

Figure 20:
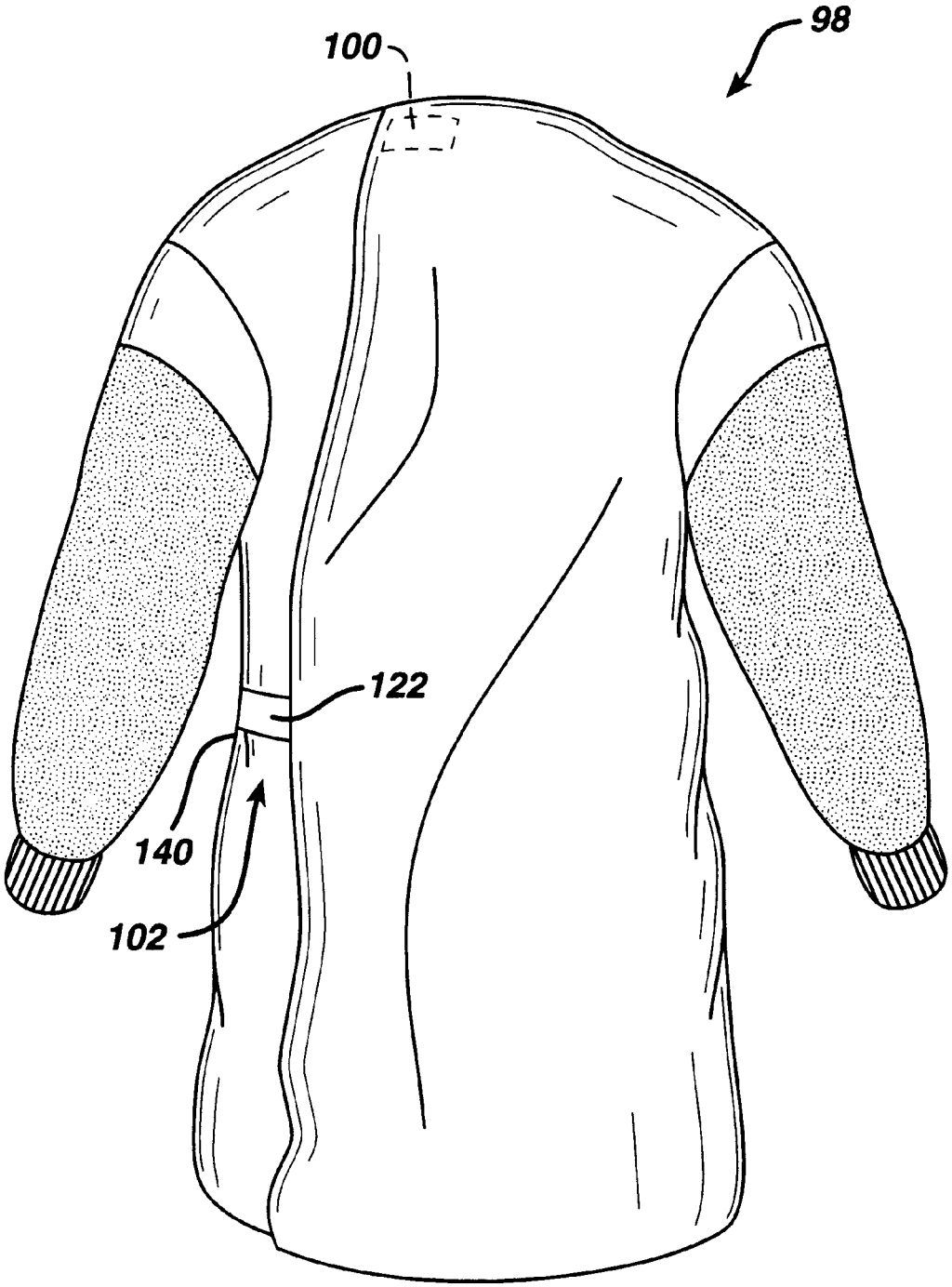
FIG. 20 is a rear elevational view of the gown of FIG. 15 shown closed.
Figure 21:
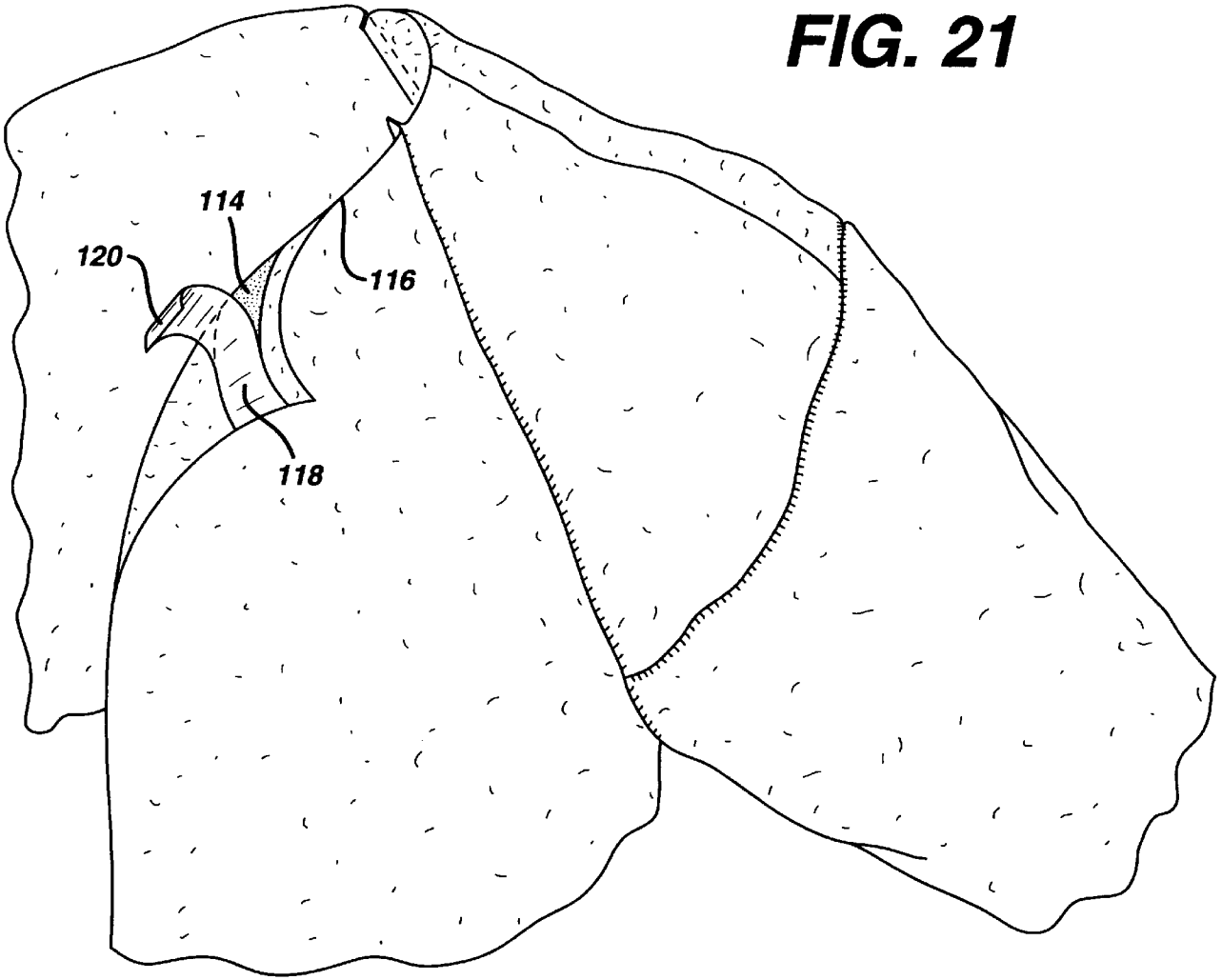
FIG. 21 is a detail in perspective view a neck closure on the gown of FIG. 15.

FIGS. 16 to 19, illustrate operation of the closure 102. First, the wearer's assistant grasps the tab 138 and lifts the release liner 132 away from the strip 122, except where the two join at their second ends 126 and 136. While holding only the release liner 132, the assistant passes the strip second end 126 behind the wearer's back to a location 140 at the side or front of the gown 98. The wearer, with sterile hands, presses only against the strip 122 to adhere the strip 122 to the gown 98 and effect closure. The assistant then removes the release liner 132. The wearer never touches the release liner 132, and the assistant touches only the release liner 132. FIG. 20 shows the closed gown 98 and FIG. 21 illustrates the neck closure 100, described above, in more detail. In any of the adhesive closures, an acrylic adhesive is preferred, but substitutions therefor will be apparent to those of skill in the art. Such substitutions could also include hook and loop closures.

Various modifications and alterations of this invention will be apparent to those skilled in the art without departing from the scope and spirit of this invention. It should be understood that the invention is not limited to the embodiments disclosed herein, and that the claims should be interpreted as broadly as the prior art allows. For instance those of skill in the art can find suitable alternatives to the specific performance enhancing coatings described herein without undue experimentation.

What is claimed is:

1. A medical gown comprising a body covering portion and sleeves extending from the body portion; the body portion having an opening for donning the gown and at least one closure for closing the opening; the closure comprising an adhesive on a first side of the opening; and a region on the second side of the opening to which the adhesive attaches to close said opening; and wherein the gown is sterile, wherein the adhesive is located on a first side of an attachment portion of the gown, and wherein the gown further comprises a removable member on a second side of the attachment portion; whereby a non-sterile hand may press against the removable member to adhere the adhesive to the region on the second side of the opening and then remove the removable member leaving a wholly sterile gown.

2. A medical gown according to claim 1 wherein the body covering portion is formed of a nonwoven fabric.

3. A medical gown according to claim 2 wherein the adhesive is printed directly onto the gown fabric on the first side.

4. A medical gown according to claim 2 wherein the adhesive comprises a piece of double-sided tape affixed to the first side.

5. A medical gown according to claim 1 wherein the removable member comprises a release member removably placed over the adhesive.

6. A medical gown according to claim 1 wherein the at least one closure further comprises indicia indicating a sequence of steps for applying said closure in a sterile fashion.

7. A medical gown according to claim 1 wherein the at least one closure further comprises indicia indicating a sequence of steps for applying said closure in a sterile fashion.

8. A medical gown comprising a body covering portion and sleeves extending from the body portion; the body portion having an opening for donning the gown and at least one closure for closing the opening; the closure comprising an adhesive on a first side of the opening; and a region on the second side of the opening to which the adhesive attaches to close said opening; and wherein the closure further comprises a removable means adjacent the opening for manipulating the closure into position for adhering the adhesive and the gown, whereby a nonsterile hand may place closure in such position and then remove the removable means to leave a sterile closed gown.

9. A method for closing a sterile medical gown comprising the steps of:

exposing an adhesive on a first side of an opening in the gown;

manipulating the closure into position for adhering the adhesive and the gown by touching only a removable member adjacent the opening;

attaching the adhesive to a location on a second side of the opening; and removing the removable member, leaving the gown sterile.

* * * * *